United States Patent [19]

Proudman

[11] 4,061,326

[45] Dec. 6, 1977

[54] APPARATUS FOR FOLDING FLATWORK

[76] Inventor: Donald Lewis Proudman, 215 Lincoln St., North Easton, Mass. 02356

[21] Appl. No.: 652,395

[22] Filed: Jan. 26, 1976

[51] Int. Cl.[2] ..... B65H 45/00

[52] U.S. Cl. ..... 270/69; 270/80; 270/83

[58] Field of Search ..... 270/62, 67, 69, 61 R, 270/80–85; 83/363, 367

[56] References Cited

U.S. PATENT DOCUMENTS

| | | | |
|---|---|---|---|
| 3,363,897 | 1/1968 | Northern | 270/84 |
| 3,485,492 | 12/1969 | Iltis | 270/84 |
| 3,706,450 | 12/1972 | Gerstenberger | 270/84 |
| 3,899,166 | 8/1975 | Behn | 270/83 |

*Primary Examiner*—Clifford D. Crowder

*Assistant Examiner*—A. Heinz

*Attorney, Agent, or Firm*—Morse, Altman, Oates & Bello

[57] ABSTRACT

A system with an ironer and a folder for pressing and folding flatwork and having a controller for sequentially actuating a folding mechanism for making folds at selected intervals in the flatwork. The controller includes a pulsing network for generating clock pulses which occur at a basic rate and for generating clock pulses which are derived from the basic rate clock pulses and which occur at rates that are multiples of the basic rate. Counters are provided for processing the derived clock pulses and for generating command wisgnals which define fold position signals. The command signals sequentially actuate the folding mechanism for making folds in the flatwork at selected intervals.

7 Claims, 10 Drawing Figures

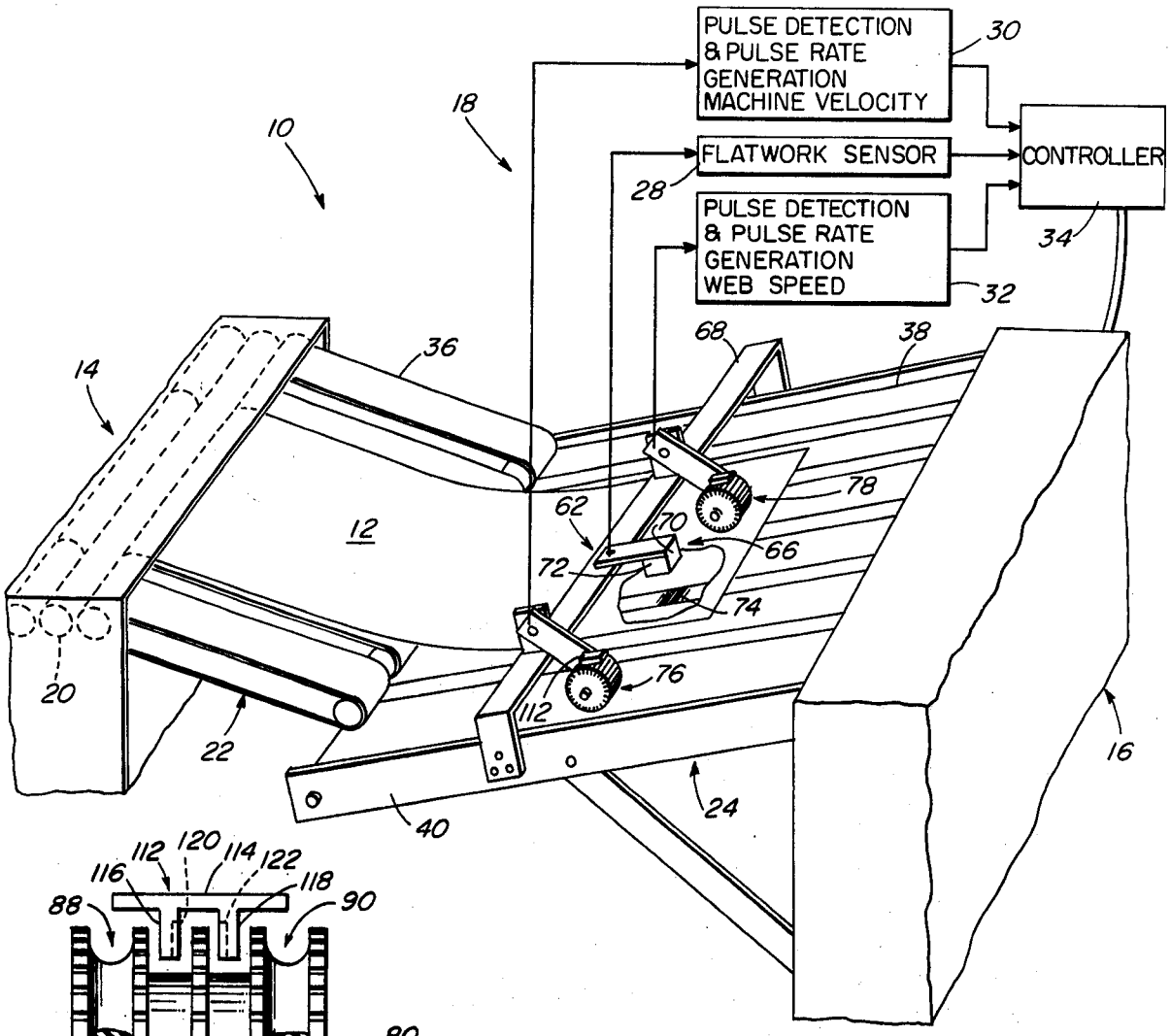
FIG. 1
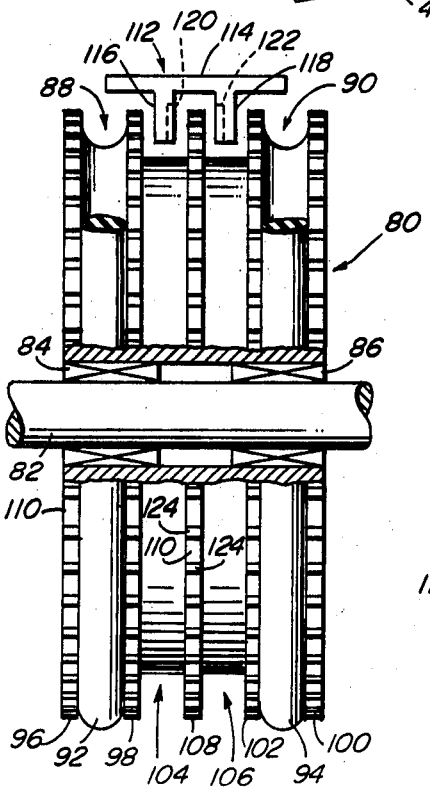
FIG. 3
FIG. 2A
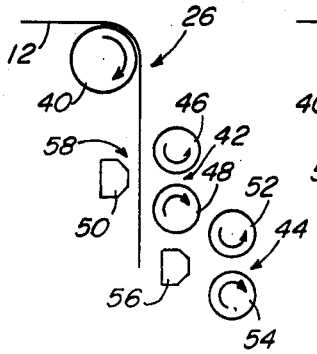
FIG. 2B
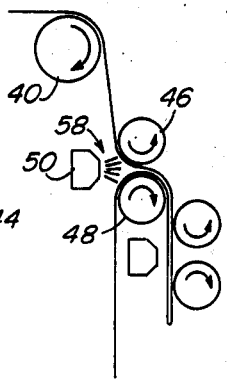
FIG. 2C
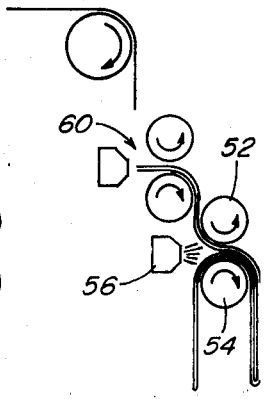

C4
C3
C2
C1
DET
B
C
D
E
F
G
H
L
SA
SB
SC
RA
RB
RC
DET
SB
RB
M
N
P
R
K1
S
K2
DET
SB
RB
M
N
P
R
K1
S
K2

APPARATUS FOR FOLDING FLATWORK

BACKGROUND OF THE INVENTION

1. Field of the Invention:

The present invention relates generally to laundry equipment and, more particularly, is directed towards flatwork folding systems.

2. Description of the Prior Art:

Generally, machines for folding flatwork include several manual operations at different stages of the folding process. Various automatic folding machines, which have incorporated analog, digital and mechanical timing devices in order to eliminate these mechanical operations, have been introduced with varying degrees of success. A need had arisen for an automatic digital folding apparatus for expeditiously and accurately folding flatwork of various sizes at selected intervals.

SUMMARY OF THE INVENTION

It is an object of the present invention to provide a digital system for automatically folding flatwork which is carried on a belt from an ironer to a folder. The invention is characterized by a controller which sequentially actuates a folding mechanism in the folder for making folds in the flatwork at selected intervals. The controller includes a pulsing network for generating clock pulses which occur at a basic rate and for generating clock pulses which are derived from the basic rate clock pulses and which occur at rates that are multiples of the basic rate. Counters are provided for processing the derived clock pulses and for generating fold position signals. A sensor assembly detects the leading edge and trailing edge of the flatwork as it advances through the folder, the length of the flatwork being defined by the number of basic rate clock pulses occurring in the time interval between the detection of the leading and trailing edges. The fold position signals are applied selectively through logic circuits to the folding mechanism, the counters being gated by command signals generated from the sensor assembly. The folding mechanism is sequentially actuated by the fold position signals for making folds in the flatwork at selected intervals.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein:

FIG. 1 is a perspective view of a system embodying the invention for making folds in a web at selected intervals;

FIG. 2A, 2B and 2C are schematic diagrams illustrating sequential steps in the folding process;

FIG. 3 is a front view, partly brokenaway, of one of the pulse rate generators of FIG. 1;

DETAILED DESCRIPTION OF THE PREFERRED EMBODIMENTS

Figure 4:
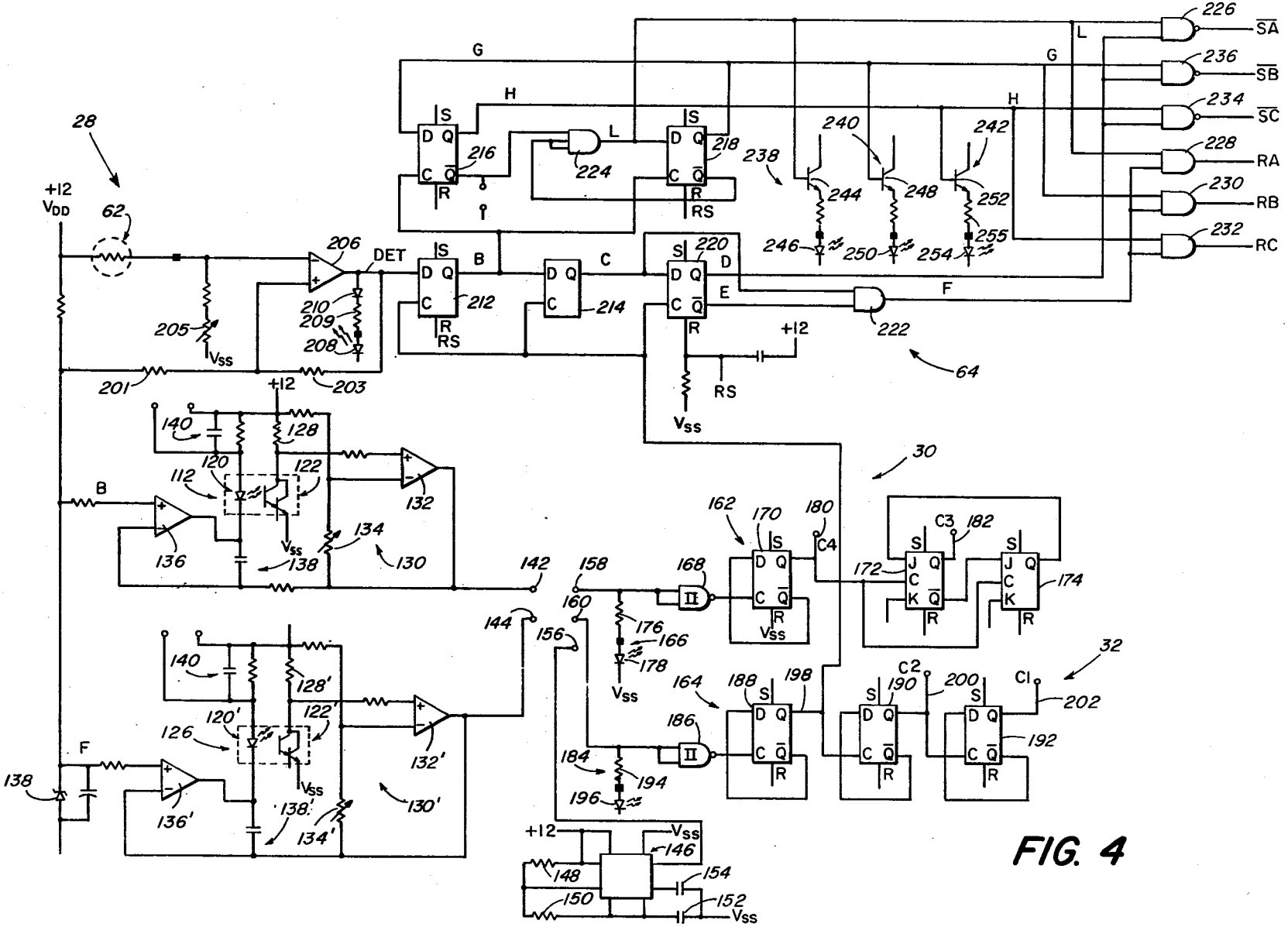
FIG. 4 is a schematic diagram of the sensor and pulse generation and detection circuitry of FIG. 1.

Referring now to the drawings, particularly FIG. 1, there is shown a system 10 for making folds in a web 12, for example flatwork, at selected intervals. Folding system 10 comprises an ironer 14, a folder 16 and a digital control assembly 18. Ironer 14 includes a plurality of rollers 20 for pressing flatwork 12 and a conveyor assembly 22 for advancing the flatwork. Folder 16 includes a conveyor assembly 24 for carrying the pressed flatwork and a folding mechanism 26 (FIG. 2). Control assembly 18 includes a sensor assembly 28, pulse generation and detection assemblies 30, 32 and a controller 34. Conveyor assembly 22 includes a plurality of endless belts 36 which carry flatwork 12 from ironer 14 to conveyor assembly 24 of folder 16. Endless belts 36 are disposed in spaced parallel relationship to one another and extend outwardly from ironer 14. Conveyor assembly 24 includes a plurality of endless belts 38 that extend from folder 16 on a frame 40, belts 38 being disposed in spaced parallel relationship to one another. Folder belts 38 are positioned to receive flatwork 12 from ironer belts 36 and feed the flatwork to folding mechanism 26.

Folding mechanism 26 comprises a guide roller 40 and folding units 42, 44. Folding unit 42 includes a pair of cooperating fold rollers 46, 48 and an actuator 50. Folding unit 44 includes a pair of cooperating fold rollers 52, 54 and an actuator 56. In the illustrated embodiment, actuators 50 and 56 are pneumatic actuators, for example air nozzles. In alternative embodiments, actuators 50 and 56 are other than pneumatic actuators, for example mechanical actuators such as lever arms. As hereinafter described, actuators 50 and 56 are selectively energized by fold signals generated by controller 34.

In operation, flatwork 12 advances from ironer 14 and is carried to folder 16 on belts 36. As the pressed flatwork leaves belts 36, it is carried by belts 38 to folding mechanism 26. The pressed flatwork is guided about roller 40 and passes into a first fold gate 58 disposed between actuator 50 and fold rollers 46, 48. Air nozzle 50 is actuated by a first fold signal generated by controller 34. In consequence, a blast of air directs flatwork 12 between fold rollers 46 and 48 for making a first fold as shown in FIG. 2B. Air nozzle 50 is actuated at such a time that flatwork 12 is folded in half. The folded flatwork passes into a second fold gate 60 disposed between actuator 56 and fold rollers 52, 54. Air nozzle 56 is actuated by a second fold signal generated by controller 34. In consequence, a blast of air directs flatwork 12 between fold rollers 52 and 54 for making a second fold as shown in FIG. 2C. Air nozzle 56 is actuated at such a time that the folded flatwork is folded in half. That is, the first fold signal folds the flatwork in half and the second fold signal folds the flatwork in quarter. In the illustrated embodiment, the fold signals are generated at the proper time by detecting the position of the flatwork, the length of the flatwork, the velocity of the flatwork when it is held by ironer 14 and is carried by both ironer conveyor assembly 22 and folder conveyor assembly 24, and the velocity of the flatwork when it is released by ironer 14 and is carried only by folder conveyor assembly 24.

As shown in FIG. 1, the position of flatwork 12 is detected by sensor assembly 28 which comprises a detector 62 and processing electronics 64 (FIG. 4). Detector 62 includes a sensor 66 that is mounted to a bracket 68 affixed to frame 40. In the illustrated embodiment, sensor 66 is an optical sensor and includes a light source 70 and a detector 72. A light beam emitted by light source 70 is directed towards a reflector 74, preferably a retro-reflector, that is disposed between adjacent belts 38 in optical registration with the light source. The light reflected by retro-reflector 74 is directed towards detector 72 to provide an indication of the presence or absence of flatwork 12. In the illustrated embodiment, the transmitted light and the reflected light are directed through a common lens (not shown). As the leading edge of flatwork 12 passes between light source 70 and retro-reflector 74, no light is directed towards detector 72. After the trailing edge of flatwork 12 passes over retro-reflector 74, the light beam emitted by source 70 is reflected towards detector 72. That is, detector 72 senses the trailing and leading edges of flatwork 12. In alternative embodiments, sensor 66 is other than an optical sensor, for example a mechanical sensor having a feeler arm that is actuated when contacted by flatwork 12 and is deactuated when out of contact with the flatwork.

The velocity of flatwork 12 is detected by a pair of encoding wheels 76 and 78 that are mounted to bracket 68. Encoding wheel 76 is positioned in contact with one of belts 38 out of the travel path of flatwork 12 and encoding wheel 78 is disposed in contact with one of belts 38 in the travel path of flatwork 12 and detector 66. In alternative embodiments, the encoding wheels are mounted to different brackets. The position of encoding wheel 78 relative to detector 66 is such that encoding wheel 78 is rotated at the speed of the flatwork when the leading edge of the flatwork is detected by detector 66. The details of encoding wheel 76, which is identical in structure and function to encoding wheel 78, is shown in FIG. 3. Encoding wheel 76 comprises an annular body 80 that is journaled on a shaft 82 by a pair of ball bearing units 84, 86. A pair of shallow U-shaped channels 88 and 90, arcuately disposed about the outer margins of body 80, are configured to receive a pair of O-rings 92 and 94, respectively. O-ring 92, which is positioned between a pair of arcuate ribs 96 and 98 that bound channel 88, extends beyond the outer edges of the ribs. O-ring 94, which is disposed between a pair of arcuate ribs 100 and 102 that bound channel 90, extend beyond the edges of the ribs. O-rings 92 and 94 constitute gripping members and provide a non-slip surface by which encoding wheel 76 is rotated. A pair of substantially U-shaped, arcuately disposed channels 104 and 106 are provided between ribs 98 and 102, an arcuate rib 108 defining a common wall between channels 104 and 106. Channels 88 and 90 are shallower than channels 104 and 106. A plurality of evenly spaced, radial slots 110 are provided about the periphery of body 80 coaxial with shaft 82. Slots 110 extend into body 80 such that the interior faces of channels 88 and 90 are slotted to provide a gripping surface for O-rings 92 and 94, and the interior faces of channels 104 and 106 are smooth. That is, in fabrication of encoding wheel 76, first, slots 110 are formed in body 80. Next, channels 88 and 90 are formed in such a manner that the depth of each channel is less than the depth of the slots. Finally, channels 104 and 106 are formed in such a manner that the depth of each channel is greater than the depth of the slots. Associated with encoder wheel 76 is a decoder 112 having a housing 114 with a pair of legs 116, 118 that straddle rib 108. Mounted to leg 116 is a light source 120, for example a light emitting diode such as a gallium arsenide solid state lamp. A photo detector 122, for example a photo sensitive transistor such as a silicon photodarlington, is mounted to leg 118 in optical registration with light source 120. The portions of body 80 which are disposed between adjacent slots 110 in rib 108 constitute teeth 124 that are operative to interrupt a light beam emitted by light source 120 and directed towards photo detector 122. In other words, as encoder wheel 76 rotates, slots 110 and teeth 124 alternately pass and inhibit the light beam emitted from light source 120 and sensed by photo detector 122. A decoder 126, which is similar in function and structure to decoder 112 is provided for encoding wheel 78. The details of decoders 112, 126 and pulse generation and detection assemblies 30, 32 are shown in FIG. 4.

Photo sensitive transistor 122 is characterized by a low impedance when illuminated by a light beam and is characterized by a high impedance in the absence of the light beam. The emitter contact of transistor 122 is connected to a return $V_{ss}$ and the collector contact is connected to a supply voltage through a resistor 128. As encoding wheel 76 rotates and chops the light directed towards photo sensitive transistor 122, the change in voltage at the collector contact constitutes a clock pulse for each tooth 124. The signals at the collector contact of transistor 122 are conditioned by a stabilization circuit 130 to generate clock pulses of particular amplitudes and rise times. In the illustrated embodiment, the nominal value of the collector current is 1 milliampere and the nominal value of the drive current for light emitting diode 120 is 10 milliamperes. Resistor 128 has a value of approximately 1K ohms in order to provide a fast rise time for the clock pulses. An operational amplifier 132 is provided to increase the collector swing of 1 volt to a swing of 10 volts, the gain of the amplifier being controlled by a variable resistor 134. The voltage swing at the output of amplifier 132 is related to the intensity of the light emitted by light emitting diode 120. A feedback amplifier 136 is provided for controlling the drive current of light emitting diode 120. The non-inverting input of feedback amplifier 136 is connected to a 6 volt reference provided by a zener diode 138 and the inverting input is connected to the output terminal of amplifier 132. A low pass filter circuit 138 is connected to the inverting input terminal of feedback amplifier 136 in order to average the signal at the output of amplifier 132. The output terminal of feedback amplifier 136 is connected to the cathode of light emitting diode 120. The anode of light emitting diode 120 is connected to a voltage source through a filter circuit 140. Amplifiers 132 and 136 are interconnected in such a manner that a decrease in the signal at the output terminal of amplifier 132 wll produce an increase in the light emitting diode drive current. Conversely, an increase in the signal at the output terminal of amplifier will produce a decrease in the light emitting diode drive current. Accordingly, the light intensity emitted by light emitting diode 120 is held relatively stable and the amplitude clock pulses generated by amplifier 132 remain relatively constant. The clock pulses generated by amplifier 132, which occur at a rate dictated by the velocity of belts 38, are presented at an output terminal 142. As previously indicated, decoder 126 is identical to decoder 112 and has corresponding components that are interconnected in the same manner. For clarity, corresponding components of decoders 112 and 126 are denoted by like reference characters and are distinguished by a prime notation. The clock pulses generated by amplifier 132' of decoder 126, which occur at a rate dictated by the velocity of flatwork 12, are presented at an output terminal 144. A clock generator 146 generates a series of clock pulses, the rate of which is governed by the values of resistors 148, 150 and a capacitor 152, a capacitor 154 constituting a filter capacitor. The series of clock pulses generated by clock 146, for example a COS/MOS linear integrated circuit timer, is presented at an output terminal 156.

The clock pulses at output terminals 142, 144 and 156 are selectively applied to input terminals 158 and 160 of pulsing circuits 162 and 164, respectively, for generating series of internal clock pulses that occur at rates which are multiples of the rate of clock pulses presented at terminals 142, 144 and 156. The term multiples used herein in connection with pulse rates is defined as including submultiples. If two encoding wheels are used for determining the velocity of flatwork 12, terminal 142 is connected to terminal 158 and terminal 144 is connected to terminal 160. In such a case, the velocity of flatwork 12 is expected to vary as the flatwork travels from ironer 14 to folder 16. If one encoding wheel is used, terminals 142, 158 and 160 are connected together. In this case, the velocity of flatwork 12 is constant and the velocity of folder 16 is expected to vary. If only the internal clock pulses are to be used, terminals 156, 158 and 160 are connected. In this case, the velocity of the flatwork 12 and folder 16 is not expected to vary.

Pulse circuit 162 comprises an indicating circuit 166, a NAND gate 168, and flip-flops 170, 172 and 174. Indicating circuit 166 includes a resistor 176 and a light emitting diode 178 that are serially connected between input terminal 158 and return $V_{ss}$. Indicator circuit 166 provides an indication that pulses are being applied to input terminal 158. NAND gate 168, for example a NAND Schmitt trigger, is connected in series between input terminal 158 and a clock input of flip-flop 170. A series of clock pulses at a basic rate are generated at a Q terminal 180 of flip-flop 170 which is interconnected in a divide by two configuration. Q terminal 180 is connected to a clock terminal of flip-flop 172 which is interconnected with flip-flop 174 to provide a series of clock pulses at a Q terminal 182 of flip-flop 172. The clock pulses at Q terminal 182 occur at a rate which is a multiple of the basic clock rate presented at Q terminal 180. Flip-flops 172 and 174 are interconnected to provide a divide by three function, the clock pulses at Q terminal 182 being at a rate which is one third of the basic rate of the clock pulses at terminal 180.

Pulsing circuit 164 comprises an indicating circuit 184, a NAND gate 186, and flip-flops 188, 190 and 192. Indicating circuit 184 includes a resistor 194 and a light emitting diode 196 that are connected in series between input terminal 160 and return $V_{ss}$ in order to provide an indication that clock pulses are being applied to input terminal 160. The clock pulses at input terminal 160 are applied to a clock input of flip-flop 188 through NAND gate 186, for example a NAND Schmitt trigger. A series of clock pulses that occur at a basic rate are generated at a Q terminal 198 of flip-flop 188. The Q terminal of flip-flop 188 is connected to the clock input terminal of flip-flop 190. A series of clock pulses, which occur at a rate that is a multiple of the basic clock rate at Q terminal 198, is generated at a Q terminal 200 of flip-flop 190. In the illustrated embodiment, the rate of the clock pulses at Q terminal 200 is one half the rate of the clock pulses at Q terminal 198. The Q terminal of flip-flop 190 is connected to the clock input of flip-flop 192. A series of clock pulses, which occur at a rate that is a multiple of the pulse rate at Q terminal 200, is generated at a Q terminal 202 of flip-flop 192. In the illustrated embodiment, the rate of the clock pulses at Q terminal 202 is one half the rate of the clock pulses at Q terminal 200 is one quarter the rate of the basic clock pulses at Q terminal 198. The basic clock pulses at Q terminal 198 are applied to sensor assembly 28.

As shown in FIG. 4, the sensitivity of detector 62 is controlled by an operational amplifier 206, a variable resistor 205, and resistors 201 and 203. When flatwork 12 is detected, the impedance of detector 62 becomes very high and causes the output of operational amplifier 206 to go high. The high level at the output of amplifier 206 energizes a light emitting diode 208 through a diode 210 and a resistor 209. Diode 210 ensures that light emitting diode 208 is activated only when flatwork 12 is disposed between detector 72 and reflector 74. The signal at the output terminal of amplifier 206 is applied to the data input terminal of flip-flop 212. The Q terminal of flip-flop 212 is connected to a data input terminal of a flip-flop 214 and the clock input terminals of flip-flops 216 and 218. The Q terminal of flip-flop 214 is connected to the data input terminal of a flip-flop 220. The basic clock pulses generated at terminal 198 of flip-flop 188 are applied to the clock input terminals of flip-flops 212, 214 and 220. The Q terminal of flip-flop 214 and the Q terminal of flip-flop 220 are connected to the input terminals of an AND gate 222, the output terminal of which is connected to an input terminal of AND gates 228, 230 and 232. The Q terminal of flip-flop 216 and Q terminal of flip-flop 218 are connected to the input terminals of an AND gate 224, the output terminal of which is connected to a date input terminal of flip-flop 218 and the input terminals of a NAND gate 226 and AND gate 228. The Q terminal of flip-flop 218 is connected to a data input of flip-flop 216 and the input terminals of a NAND gate 236 and AND gate 230. The Q terminal of flip-flop 216 is connected to the input terminal of a NAND gate 234 and AND gate 232.

The signal at the Q terminal of flip-flop 220 is applied to the other input terminals of NAND gates 226, 234, and 236. The signals at the output terminals of NAND gates 226, 236 and 234, which constitute clock select signals for controller 34, are denoted as $\overline{SA}$, $\overline{SB}$ and $\overline{SC}$, respectively. The signals at the output terminals of AND gates 228, 230 and 232, which constitute reset signals for controller 34, are denoted as RA, RB and RC, respectively. In order to provide an indication of the set signals $\overline{SA}$, $\overline{SB}$ and $\overline{SC}$, there is provided indicating circuits 238, 240 and 242, respectively. Indicating circuit 238 includes a transistor driver 244 and a light emitting diode 246. The base contact of transistor 244 is connected to the output terminal of AND gate 224 and diode 246 is connected between the emitter contact of transistor 244 and return $V_{ss}$. Indicating circuit 240 includes a transistor driver 248 and a light emitting diode 250. The Q terminal of flip-flop 218 is connected to the base contact of transistor 248. Light emitting diode 250 is connected between the emitter contact of transistor 248 and return $V_{ss}$. Indicator circuit 242 includes a transistor driver 252 and a light emitting diode 254. The base contact of transistor 252 is connected to the Q terminal of flip-flop 216 and diode 254 is connected to the emitter contact of transistor 252 through a resistor 255. The timing diagram for sensor assembly 28 and pulse generation and detection assemblies 30, 32 are shown in FIG. 6.

Figures 6, 7, 8:
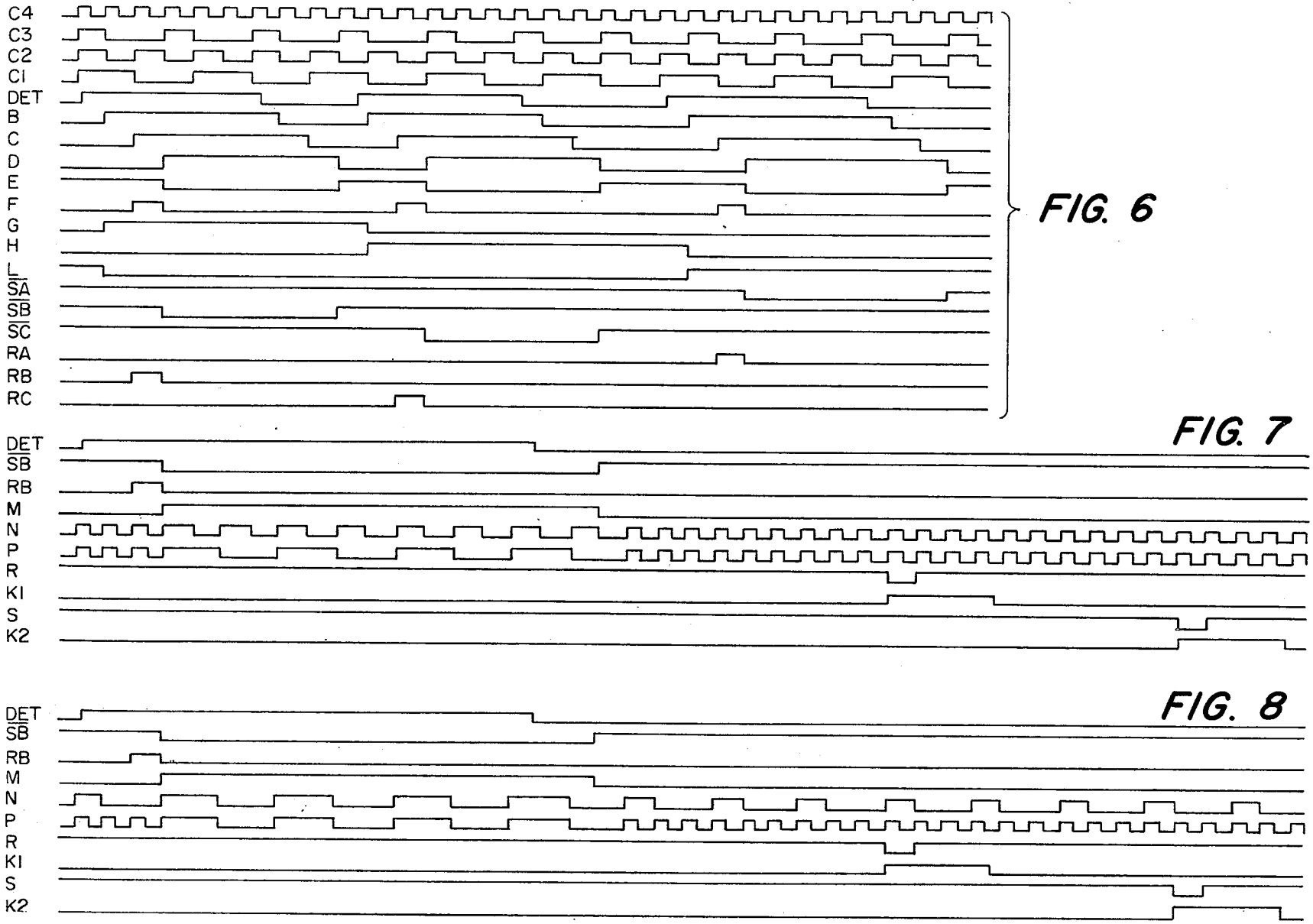
FIG. 6 is a timing diagram of the sensor and pulse generation and detection circuitry of FIG. 4.
FIG. 7 is a timing diagram of the controller of FIG. 5 for making half and quarter folds.
FIG. 8 is a timing diagram of the controller of FIG. 5 for making quarter folds.

The basic clock pulses at the Q terminals of flip-flops 170 and 188 are denoted as C4 in FIG. 6. The multiple rate clock pulses at the Q terminals of flip-flops 172, 190 and 192 are denoted as C3, C2 and C1, respectively. The signals at the output of amplifier 206, denoted as DET, are positive pulses during the time interval that flatwork 12 is disposed between detector 72 and reflector 74. Flip-flop 212, which is clocked by C4 pulses and is gated by the DET pulses on its data input, generates positive pulses B from its Q terminal that correspond in duration to the DET pulses. Flip-flop 214, which is clocked by the C4 pulses and is gated by the B pulses on its data input, generates positive pulses C from its Q terminal that correspond in duration to the B pulses. Flip-flop 220, which is gated by the C pulses and is clocked by the C4 pulses, generates positive pulses D from its Q terminal and complementary pulses E from its $\overline{Q}$ terminal, the duration of the D and E pulses correspond in duration to the C pulses. The C and E pulses are applied in the input of AND gate 222, the output of which is a positive pulses F when both C and E are high. Flip-flop 216, which is clocked by B pulses and is gated by G pulses at the Q terminal of flip-flop 218, generates positive pulses H. The complement of the G and H pulses at the $\overline{Q}$ terminals of flip-flops 216 and 218 are applied to AND gate 224. The output signal L of AND gate is applied as the data input signal to flip-flop 218. The signals $\overline{SA}$, $\overline{SB}$, $\overline{SC}$ and the reset signals RA, RB and RC are derived by selectively applying the D, F, G, H and L signals to gates 226, 228, 230, 232, 234 and 236. The C1, C2, C3, C4 clock pulses, the signals $\overline{SA}$, $\overline{SB}$, $\overline{SC}$, and the reset signals RA, RB, RC are applied to controller 34.

Figure 5:
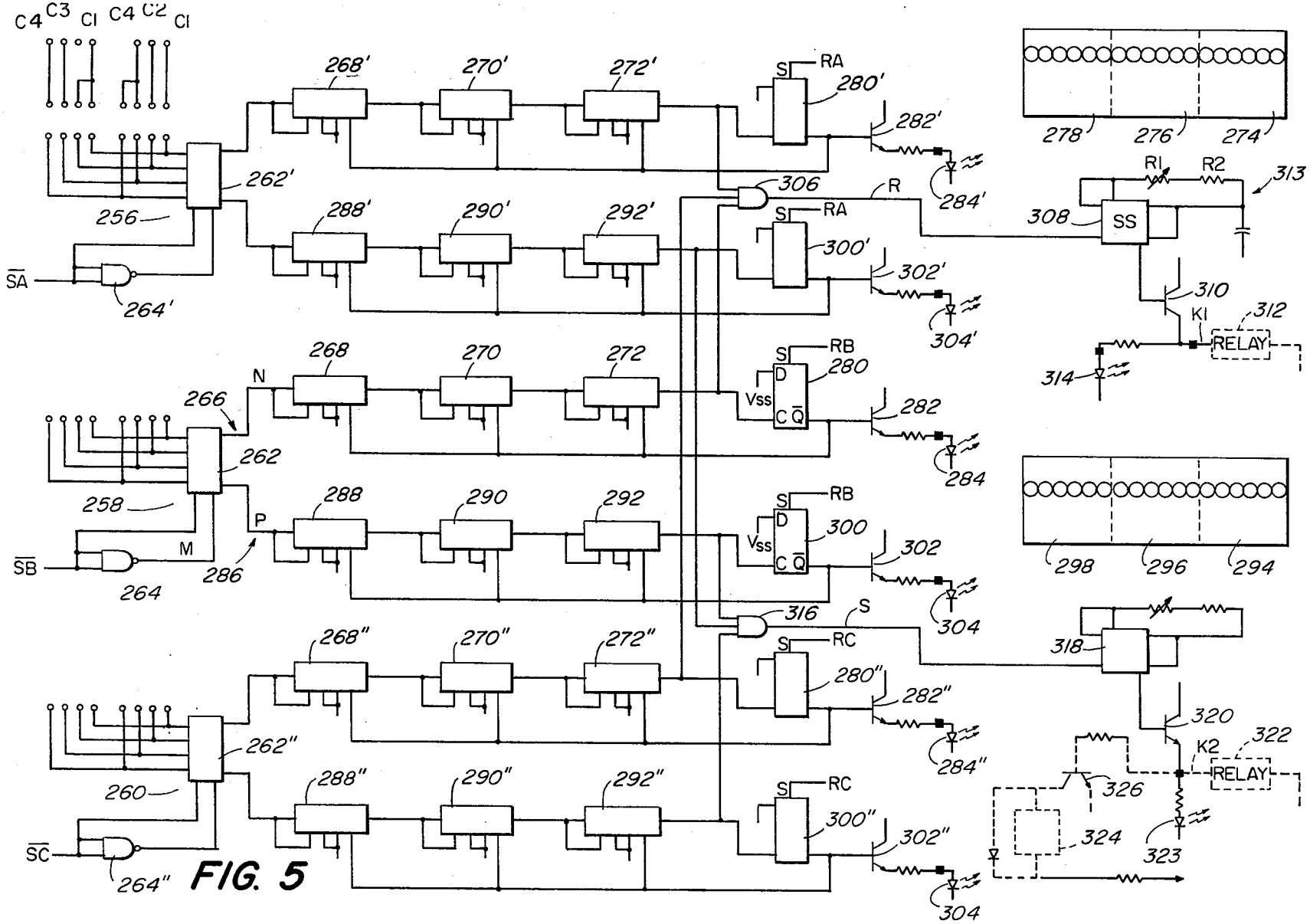
FIG. 5 is a schematic diagram of the controller of FIG. 1.

As shown in FIG. 5, controller 34 includes banks of digital counting sections 256, 258 and 260, each of which includes identical counting sections 256, 258 and 260, each of which includes identical components that are interconnected in an identical manner. Corresponding components of counting sections 256, 258 and 260 are denoted by like reference characters and are distinguished from one another by primed notations. Counting section 256 is gated by signal $\overline{SA}$ and is reset by reset signal RA; counting section 258 is gated by signals $\overline{SB}$ and is reset by reset signal RB; and counting section 260 is gated by signals $\overline{SC}$ and is reset by reset signal RC. The reset signals RA, RB and RC are applied to the set terminal of their respective flip-flops and are operative to enable the counting sections to count the clock pulses. The following description of counting section 258 is applicable to counting sections 256 and 260. A timing diagram for counting section 258 is given in FIG. 7.

Clock select signal $\overline{SB}$ is applied as a control signal to a logic unit 262, for example a COS/MOS quad AND-OR select gate, directly and through a NAND gate 264. Selected ones of clock pulse signals C1, C2, C3 and C4, are applied also to gate 262. The signal N (FIG. 7) at an output terminal 266 of gate 262 is applied to serially connected up/down counters 268, 270 and 272 which are preset by first fold digital switches 274, 276 and 278, respectively. Counters 268, 270 and 272 represent the units, tens and hundreds digits, respectively. In the illustrated embodiment, a preset count of clock pulses is entered into counters 268, 270, 272. The present count represents the distance in clock pulses from sensor assembly 66 to fold mechanism 50. The counters are progressively down counted by the clock pulses N, each clock pulse constituting one count. Counter 272 is connected to a clock input terminal of a flip-flop 280. Reset signal RB is applied to flip-flop 280 and a low signal is generated at the $\overline{Q}$ terminal of the flip-flop, allowing counters 268, 270 and 272 to proceed counting at a rate determined by clock pulses N, namely one count for each clock pulse. At the end of the counting cycle for the first fold, the signal at the $\overline{Q}$ terminal of flip-flop 280 goes high and counters 268, 270 and 272 are reset to the present numbers established by digital switches 274, 276 and 278, for example thumbwheel switches. When the signal at the $\overline{Q}$ terminal of flip-flop 280 goes high, a transistor 282 is turned on and a light emitting diode 284 in energized to provide an indication of the first fold.

The signal P (FIG. 7) at an output terminal 286 of gate 262 is applied to serially connected up/down counters 288, 290 and 292 which are preset by second fold digital switches 294, 296 and 298, respectively. Counters 288, 290 and 292 represent the units, tens and hundreds digits, respectively. In the illustrated embodiment, a preset count in entered into counters 288, 290 and 292. The preset count represents the distance in clock pulses from sensor assembly 66 to fold mechanism 56. The counters are progressively down counted by the clock pulses P, each clock pulse constituting one count. Counter 292 is connected to a clock input terminal of a flip-flop 300. Reset signal RB is applied to flip-flop 300 and low signal is presented at the $\overline{Q}$ terminal of the flip-flop allowing counters 288, 290 and 292 to proceed counting at a rate determined by clock pulses P, namely one count for each clock pulse. At the end of the counting cycle for the second fold, the signal at the $\overline{Q}$ terminal of flip-flop 300 goes high and counters 288, 290 and 292 are reset to the present numbers established by digital switches 294, 296 and 298, for example thumbwheel switches. When the signal at the $\overline{Q}$ terminal of flip-flop 300 goes high, a transistor 302 is turned on and a light emitting diode 304 is energized to provide an indication of the second fold.

During detection, the clock select signal $\overline{SB}$ is low, the signal M is high and the measuring clock pulses C1 and C2 are generated at the output terminals of gate 262. After detection, the clock select signal $\overline{SB}$ is high, the signal M is low and the folding clock pulses C4 are generated at the output terminals of gate 262.

As shown in FIG. 5, the corresponding components of counting section 256 are distinguished by a single prime notation and the corresponding components of counting section 260 are distinguished by a double prime notation. Thumbwheel switches 274, 276, 278, 294, 296 and 298 are used with counting sections 256 and 260 as well as counting section 258 in the manner hereinbefore described. In the illustrated embodiment, counting sections 256, 258 and 260 are used respectively for the first, second and third pieces of flatwork leaving ironer 14. The fourth piece of flatwork utilizes counting section 256, the fifth piece uses counting section 258 and so forth.

The signals at the output terminals of counters 272, 272′ and 272″ are applied to input terminals of an AND gate 306. The signal at the output terminal of AND gate 306 drives a single shot 308 which turns on a transistor 310. When transistor 310 is turned on, it energizes a relay 312 which actuates the first folding mechanism, the timing for the first fold being governed by RC circuit 313. Transistor 310 also energizes a light emitting diode 314 which provides an indication that the first folding mechanism has been actuated. The signals at the output terminals of counters 292, 292' and 292" are applied to input terminals of an AND gate 316. The signal at the output of AND gate 316 drives a single shot 318 which turns on a transistor 320. When transistor 320 is turned on, it energizes a relay 322 which actuates the second folding mechanism. In addition, transistor 320 energizes a light emitting diode 323 which provides an indication that the second folding mechanism has been actuated. A counter 324, which provides an indication of the number of pieces of flatwork folded, is driven by a transistor 326 that is energized by transistor 320.

As previously indicated, each encoding wheel generates pulses that occur at a rate proportional to the velocity of the flatwork, the pulse rates are in terms of pulses per unit length of flatwork and are independent of belt speed. The timing defining the times at which the folds are to be made if the flatwork is to be folded twice, in half and in quarter, is shown in FIG. 7. Such folds are performed in accordance with the following algorithm where:

S = the length of the flatwork
$L_1$ = the distance from the flatwork detector to the first fold location
$L_2$ = the distance between the first fold location and the second fold location
$\alpha_1$ = the pulse rate during detection for the first fold
$\alpha_2$ = the pulse rate during detection for the second fold
$\beta_1$ = the pulse rate after detection for the first fold
$\beta_2$ = the pulse rate after detection for the second fold The number of pulse counts accumulated during flatwork detection for the first fold is $S \times \alpha_1$;

the number of pulse counts accumulated after detection and until the leading edge of flatwork reaches the first fold location is $(L_1 - S)\beta_1$; and the number of pulse counts accumulated after the leading edge reaches the first fold location and until the center of the flatwork is at the first fold location is $(S/2)\beta_1$.

It is desired that, for the first fold, the total count is equal to a constant value $K_1$ which is independent of the length of the flatwork.

Therefore, for the first fold $$S\alpha_1 + \beta_1(L_1 - S) + \beta_1(S/2) = K_1$$

or $$S(\alpha_1 - \beta_1 + \beta_1/2) + \beta_1 L_1 = K_1$$

Since $K_1$ is independent of $S$ $$\alpha_1 - \beta_1 + \beta_1/2 = 0$$

or $$\beta_1 = 2\alpha_1$$

and $$K_1 = L_1\alpha_1$$

At the end of the $K_1$ count, the first fold is made. A similar analysis is provided for the second fold.

$S \times \alpha_2$ = the number of counts accumulated during flatwork detection
$(L_1 = S)\beta_2$ = the number of counts accumulates after detection and until the leading edge of flatwork reaches the first fold position
$(S/2)\beta_2$ = the number of counts accumulated after the leading edge reaches the first fold location and until the center of the flatwork is at the first fold position $L_2 \times \beta_2$ = the number of counts accumulated after the first fold and until the leading edge of the folded flatwork reaches the second fold position
$(S/4)\beta_2$ = the number of counts accumulated after the leading edge of the half folded sheet reaches the second fold position and until the center of the folded flatwork is at the second fold position It is desired that, for the second fold, the total count is equal to a constant value $K_2$ which is independent of the length of the flatwork.

$$S\alpha_2 + (L_1 - S)\beta_2 + (S/2)\beta_2 + L_2\beta_2 + (S/4)\beta_2 = K_2$$

or $$S(\alpha_2 - (\beta_2/4)) + \beta_2(L_1 + L_2) = K_2$$

Since $K_2$ is independent of S $$\alpha_2 - (\beta_2/4) = 0$$

or $$\beta_2 = 4\alpha_2$$

and $$K_2 = (L_1 + L_2)\beta_2$$

At the end of the $K_2$ count, the second fold is made.

The second counting rate for the second fold computation is equal to four times the first counting rate and the total count $K_2$ is $\beta_2$ times the combined lengths $L_1$ and $L_2$.

The accuracy in the location of the folds, which is a function of absolute pulse rates, is defined by the foregoing algorithm. A faster pulse rate will provide increased resolution, however the foregoing pulse rate ratios must be maintained.

In an alternative embodiment of the invention, the timing diagram of which is presented in FIG. 8, the flatwork is quarter folded by a single folding mechanism, the following algorithm is applicable.

where:

S = the length of the flatwork
L = the distance between the flatwork leading edge detector and the folding mechanism
$\alpha_3$ = the pulse rate during detection for first fold
$\alpha_4$ = the pulse rate during detection for second fold
$\beta_3$ = the pulse rate after detection for first fold
$\beta_4$ = the pulse rate after detection for second fold
$F_1$ = the accumulated count for the first fold location
$F_2$ the accumulated count for the second fold location
$F_1 = \alpha_3 S + \beta_3(L - S) + \beta_3 S/4 = S(\alpha_3 - \beta_3 + \beta_3/4) + \beta_3 L$ It is desired that, for the first fold, the accumulated count $F_1$ is independent of the flatwork length S. therefore $$\alpha_3 - \beta_3 + \beta_3/4 = 0$$

or $$\beta_3 = 4/3\alpha_3$$

and $$F_1 = \beta_3 L$$

$$F_2 = \alpha_4 S + \alpha_4 (L - S) + \beta_4 S/4 + \beta_4 S/2 = S(\alpha_4 - \beta_4 + \beta_4/4 + \beta_4/2) + \beta_4 L$$

It is desired that, fore the second fold, the accumulated count $F_2$ is independent of flatwork length S.

Therefore, $$\alpha_4 - \beta_4 + \beta_4/2 + \beta_4/4 = 0$$

or $$\beta_4 = 4\alpha_4$$

$$F_2 = \beta_4 L$$

The accuracy in the locations of the folds, which is a function of the absolute pulse rates, is defined by the foregoing algoritym. A faster pulse rate will provide increased resolution. However, the foregoing pulse rate ratios must be maintained.

In the embodiment illustrated in the timing diagram of FIG. 7, a set of digital dividers is provided to count down the clock pulses to provide the suitable rates to satisfy the above algorithm. For the first fold, the preset number is 18 for example, the $\alpha_1$ rate is provided by $C_2$ and the $\beta_1$ rate is provided by $C_4$. For the second fold, the reset number is 24, for example, the $\alpha_2$ rate is provided by $C_1$ and that $\beta_2$ rate by $C_4$.

In the illustrated embodiment in the timing diagram of FIG. 8, $\alpha_3$ is provided by $C_1$, $\beta_3$ by $C_3$, $\alpha_4$ by $C_1$ and $\beta_4$ by $C_4$. By way of example, in the FIG. 8 embodiment, the preset numbers for the first and second folds are 8 and 24, respectively.

Since certain changes may be made in the foregoing disclosure without departing from the scope of the invention herein involved, it is intended that all matter contained in the above description be construed in an illustrative and not in a limiting sense.

What is claimed is:

1. In combination with an ironer and a folder, a digital control system for making folds at selected intervals in flatwork moving from said ironer to said folder, said folder including a folding mechanism that is responsive to said digital control system for making said folds, said digital control system comprising:

a. sensor means for detecting said moving flatwork and for generating a first signal indicating such detection, said sensor means located at a single location along the travel path of said web;

b. clock means for generating a first and a second series of clock pulses, said first series of clock pulses occurring at a basic rate, said second series of clock pulses occurring at a rate which is one third said basic rate;

c. controller means connected to said sensor means and said clock means, said controller means including at least first and second digital counter means for counting said clock pulses, said clock pulses occurring at said basic rate and said clock pulses occurring at said one third rate are applied to said second and first digital counter means, respectively; and d. digital switch means connected to said first and second digital counter means for establishing a preset count of clock pulses in each said digital counter means, each said preset count representing a specific number of clock pulses, said first digital counter means generating a first fold signal when the number of clock pulses applied thereto is equal to said preset count established therein, said second digital counter means generating a second fold signal when the number of clock pulses applied thereto is equal to said preset count established therein, said first and second fold signals operative to actuate said folding mechanism for folding said flatwork at selected intervals.

2. In combination with an ironer and a folder, a digital control system for making folds at selected intervals in flatwork moving from said ironer to said folder, said folder including a folding mechanism that is responsive to said digital control system for making said folds, said digital control system comprising:

a. said sensor means for detecting said moving flatwork and for generating a first signal indicating such detection, said sensor means located at a single location along the travel path of said web;

b. clock means for generating a first, a second and a third series of clock pulses, said first series of clock pulses occurring at a basic rate, said second series of clock pulses occurring at a rate which is one quarter said basic rate, said third series of clock pulses occurring at a rate which is one third said basic rate;

c. controller means connected to said sensor means and said clock means, said controller means including at least first and second digital counter means for counting said clock pulses, said second and said third series of clock pulses applied to said first digital counter means, said first and said second series of clock pulses applied to said second digital counter means; and d. digital switch means connected to said first and second digital counter means for establishing a preset count of clock pulses in each said digital counter means, each said preset count representing a specified number of clock pulses, said first digital counter means generating a first fold signal when the number of clock pulses applied thereto is equal to said preset count established therein, said second digital counter means generating a second fold signal when the number of clock pulses applied thereto is equal to said preset count established therein, said first and second fold signals operative to actuate said folding mechanism for folding said flatwork at selected intervals.

3. A system for use with a folding machine for folding a moving web at selected intervals, said system comprising:

a. sensor means for detecting the presence of said moving web and for generating a first signal indicating such detection, said sensor means disposed at a single location along the travel path of said web;

b. first clock means for generating a series of clock pulses which occur at a basic rate related to the velocity of said moving web;

c. second clock means for generating a series of clock pulses which occur at a rate which is a multiple of said basic rate;

d. controller means connected to said sensor means, said first clock means and said second clock means, said controller means including at least two digital counter means for respectively counting said clock pulses generated by said first and second clock means, each of said digital counter means placed into a state for counting by said first signal;

e. digital switch means connected to each of said digital counter means for establishing a preset count of clock pulses in each said digital counter means, each preset count representing a specified number of clock pulses, each said digital counter means generating a fold signal for actuating said folding machine when the number of clock pluses applied thereto corresponds to said preset count established therein;

f. third clock means for generating a series of clock pulses which occur at a rate which is a multiple of said basic rate, said clock pulses generated by said second clock means occurring at a rate which is one half said basic rate, said clock pulses generated by said third clock means occurring at a rate which is one fourth said basic rate, said series of clock pulses generated by said first and said third clock means applied to one of said digital counter means; and g. fourth clock means for generating a series of clock pulses which occur at a rate which is one third said basic rate, one of said series of clock pulses generated by said first and second clock means and said series of clock pulses generated by said third and said fourth clock means applied to the other of said digital counter means.

4. The system as claimed in claim 3 wherein said digital counting means includes first and second counting means and said digital switch means includes first and second switch means, said first counting means preset by said first switch means and said second counting means preset by said second switch means, said clock pulses generated by said first, second, third and fourth clock means are selectively applied to said first counting means and said clock pulses generated by said first and third clock means are selectively applied to said second counting means, said first counting means generating a first fold signal and said second counting means generating a second fold signal.

5. In combination with an ironer and a folder, a digital control system for making folds at selected intervals in flatwork moving from said ironer to said folder, said folder including a folding mechanism that is responsive to said digital control system for making said folds, said digital control system comprising:

a. sensor means for detecting said moving flatwork and for generating a first signal indicating such detection;

b. clock means for generating a first and a second series of clock pulses, said first series of clock pulses occurring at a basic rate, said second clock pulses occurring at a rate which is multiple of said basic rate;

c. controller means connected to said sensor means and said clock means, said controller means including at least first and second digital counter means for counting said clock pulses, said clock pulses occurring at said basic rate and said multiple rate are applied selectively to said first and second digital counter means; and d. digital switch means connected to said first and second digital counter means for establishing a preset count of clock pulses in each said digital counter means, each said preset count representing a specified number of clock pulses, said first digital counter means generating a first fold signal when the number of clock pulses applied thereto is equal to said preset count established therein, said second digital counter means generating a second fold signal when the number of clock pulses applied thereto is equal to said preset count established therein, said first and second fold signals operative to actuate said folding mechanism for folding said flatwork at selected intervals;

e. said clock means including an encoding wheel and a decoder, said encoding wheel rotated at a rate related to the velocity of said moving flatwork, said encoding wheel having a coaxial arcuate rib that is provided with a plurality of radially extending teeth, said decoder having a pair of extending legs that straddle said rib, a light source mounted to one of said legs and a photo detector mounted to the other of said legs, said light source generating a light beam towards said photo detector, said teeth disposed between said light source and said photo detector, said teeth alternately inhibiting and passing said said light beam directed at said photo detector for generating said basic rate clock pulses.

6. A system for use with a folding machine for folding a moving web at selected intervals, said system comprising:

a. sensor means for detecting said moving web and for generating a first signal indicating such detection;

b. first clock means for generating a series of clock pluses which occur at a basic rate related to the velocity of said moving web;

c. second clock means for generating a series of clock pulses which occur at a rate which is a multiple of said basic rate;

d. controller means connected to said sensor means, said first clock means and said second clock means, said controller means including digital counter means, for counting said clock pulses, each of said digital counter means set by said first signal, said clock pulses which occur at said basic rate and said clock pulses which occur at said multiple rate are applied selectively to said digital counter means; and e. digital switch means connected to said digital counter means for establishing a preset count of clock pulses in said digital counter means, said preset count representing a specified number of clock pulses, each of said clock pulses constituting one of said preset count, said counter means generating a folding signal for actuating said folding machine when the number of clock pulses applied thereto corresponds to said preset count established therein;

f. said first clock means including an encoding wheel and a decoder, said encoding wheel having a coaxial arcuate rib that is formed with a plurality of teeth, said decoder provided with a pair of legs that straddle said arcuate rib, a light source mounted to one of said legs and a photo detector mounted to the other of said legs, said light source in optical registration with said photo detector, said teeth operative to alternately inhibit and pass a light beam emitted by said light source and directed towards said photo detector for generating said basic rate clock pulses.

7. The system as claimed in claim 6 wherein said encoding wheel includes at least one O-ring disposed about its periphery, said O-ring constituting a gripping surface.

* * * * *